US008511630B2

(12) United States Patent
Varieur

(10) Patent No.: US 8,511,630 B2
(45) Date of Patent: Aug. 20, 2013

(54) EMERGENCY NOTIFICATION APPLIANCE MOUNTING BRACKET

(75) Inventor: Steven T. Varieur, Winchendon, MA (US)

(73) Assignee: SimplexGrinnell LP, Westminster, MA (US)

( * ) Notice: Subject to any disclaimer, the term of this patent is extended or adjusted under 35 U.S.C. 154(b) by 626 days.

(21) Appl. No.: 12/249,580

(22) Filed: Oct. 10, 2008

(65) Prior Publication Data

US 2010/0090857 A1 Apr. 15, 2010

(51) Int. Cl.
*A47F 5/00* (2006.01)

(52) U.S. Cl.
USPC ..... 248/300; 248/906

(58) Field of Classification Search
CPC ..... G08B 7/06; H02G 3/08
USPC ..... 248/300, 906, 174, 247, 248, 309.1, 248/310, 317, 346.06, 447.1, 544, 224.8, 248/225.11; 174/535, 61, 503, 480, 56, 50, 174/50.51, 53, 54, 55, 57, 58, 66, 481; 439/607.55, 607.44, 607.28, 607.27; 224/557, 224/555, 545; 116/305; 206/721, 701; 73/431, 73/866.3; 220/3.2, 3.3; 361/796, 658
See application file for complete search history.

(56) References Cited

U.S. PATENT DOCUMENTS 3,511,941 A * 5/1970 Quigley ..... 379/454
3,721,762 A * 3/1973 Gooding ..... 174/504
3,849,608 A * 11/1974 Bustos et al. ..... 379/454
3,919,459 A * 11/1975 Van Steenhoven ..... 174/63
3,941,951 A * 3/1976 Engstrom et al. ..... 379/436
4,491,696 A * 1/1985 Haskins et al. ..... 379/435
4,887,073 A * 12/1989 Nakao et al. ..... 340/693.11
5,303,292 A * 4/1994 Takahashi et al. ..... 379/454
5,400,400 A * 3/1995 Hird et al. ..... 379/453
5,614,695 A * 3/1997 Benito Navazo ..... 174/480
5,646,371 A * 7/1997 Fabian ..... 174/58
5,684,467 A 11/1997 Hur
5,693,908 A * 12/1997 Amberger ..... 174/656
5,699,221 A * 12/1997 O'Leary et al. ..... 361/160
5,914,665 A 6/1999 Thorp et al.
6,066,803 A * 5/2000 Hagarty ..... 174/50
6,127,935 A * 10/2000 Davidson et al. ..... 340/691.5
6,133,843 A * 10/2000 Davidson ..... 340/693.9
6,135,624 A * 10/2000 Masters et al. ..... 362/432
6,140,579 A * 10/2000 Niedermann et al. ..... 174/561
6,158,180 A * 12/2000 Edwards ..... 52/220.7
6,838,997 B1 1/2005 Davidson
6,956,169 B1 * 10/2005 Shotey et al. ..... 174/58
7,053,300 B2 5/2006 Denier et al.
7,183,483 B1 * 2/2007 Anderson et al. ..... 174/50
7,279,635 B2 * 10/2007 Hyde ..... 174/58
7,321,120 B1 * 1/2008 Gorman et al. ..... 250/338.1
7,342,173 B1 * 3/2008 Kidman ..... 174/58
7,398,949 B2 7/2008 Weech et al.
7,439,442 B2 * 10/2008 Schutte ..... 174/50
2004/0051648 A1 * 3/2004 Hagarty et al. ..... 340/693.9

(Continued)

*Primary Examiner* — Terrell McKinnon
*Assistant Examiner* — Eret McNichols
(74) *Attorney, Agent, or Firm* — Kacvinsky Daisak pllc

(57) ABSTRACT

A mounting bracket for attaching an plurality of alarm notification devices to an electrical box. The mounting bracket includes a first mounting section to receive a first alarm notification device and a second mounting section to receive a second alarm notification device. The second mounting section defines an enclosure which houses the electrical wires connected between the alarm notification devices.

20 Claims, 5 Drawing Sheets

(56) References Cited

U.S. PATENT DOCUMENTS

2006/0065510 A1* 3/2006 Kiko et al. ..... 200/1 R
2008/0029286 A1* 2/2008 Schutte ..... 174/50
2008/0251650 A1* 10/2008 Borbolla et al. ..... 248/27.1
2009/0072989 A1* 3/2009 Rock et al. ..... 340/691.1

* cited by examiner

EMERGENCY NOTIFICATION APPLIANCE MOUNTING BRACKET

FIELD OF THE INVENTION

Embodiments of the invention relate to the field of alarm communication units. More particularly, embodiments of the invention relate to a mounting bracket for support of a flush or surface mounted visible strobe emergency notification unit.

DISCUSSION OF RELATED ART

Typical building alarm systems include a number of notification appliances positioned throughout a building to alert occupants of fire and non-fire emergencies. These notification appliances include smoke detectors, fire alarms, security alarms and emergency lighting. A visible only (V/O) strobe is one type of notification appliance which is used as a visual alarm indicator and is required as an alert for the hearing-impaired, or for those in a high noise environment where an audible alarm is impractical A V/O strobe is typically made up of a high-intensity Xenon flash tube designed to disperse light in a hemispherical pattern. Often times a dual strobe device is used that includes one strobe which outputs a first color light to indicate one type of emergency and a second strobe which outputs a second color light something other than a fire emergency. For example, a clear white strobe light indicates a fire emergency and an amber light strobe indicates a non-fire emergency. These strobe lights are typically surface mounted on a building wall a particular distance above the floor to provide the maximum amount of light output for a particular candela rating. Because these units are typically larger than a standard light, they may be mounted on a four (4) gang electrical box, but may also be mounted on a smaller 4" square box depending on the particular circuit design within the building. These larger strobe lights also require specially designed mounting brackets that support the lights on a wall while providing a path for power wires from the multi-gang electrical boxes to the lights. In addition, the dual strobe electrical connections must comply with local building codes and UL (Underwriters Laboratory) requirements. In particular, the mounting brackets must provide sufficient protection for the power wires which run from the electrical box through the mounting bracket and connect to each of the strobes.

Prior attempts at "universal" type mounting plates were useful for mounting alarm notification devices to more than one type of electrical box, but do not accommodate the larger dual strobe design nor do they satisfy UL requirements for compliant wire connections. In addition, alternative mounting brackets or plates used the wall upon which the lights were mounted to form part of the enclosure for the power wires. This mounting configuration provided sufficient support for the lights, but did not satisfy UL guidelines with respect to the wall acting as part of the wire enclosure. Thus, there is a need to provide a mounting bracket that supports a dual strobe design device which connects to a variety of electrical boxes while providing a sufficient enclosure to protect the wires supplying power to the device.

SUMMARY OF THE INVENTION

Exemplary embodiments of the present invention are directed to a mounting bracket for mounting an alarm notification device. In an exemplary embodiment, the mounting bracket includes a generally rectangular planar back plate extending from an upper portion to a lower portion. The back plate is disposed between the notification device and an electrical box for mounting thereto. The lower portion of the back plate is configured to engage with at least a first portion of the notification device. An upper wall is connected to the upper portion of the back plate and extends a distance outward generally perpendicular to the back plate. A lower wall is connected to the back plate a distance below the upper wall and extends the same distance as the upper wall and generally perpendicular to the back plate. A mounting face is disposed between the upper and lower walls and extends generally parallel to the back plate. The mounting face is configured to engage with at least a second portion of the notification device. The mounting face contains an aperture which extends into the lower wall and is configured to receive an electrical connection from the first part of the notification device to the second part of the notification device.

DESCRIPTION OF EMBODIMENTS

Figure 1:
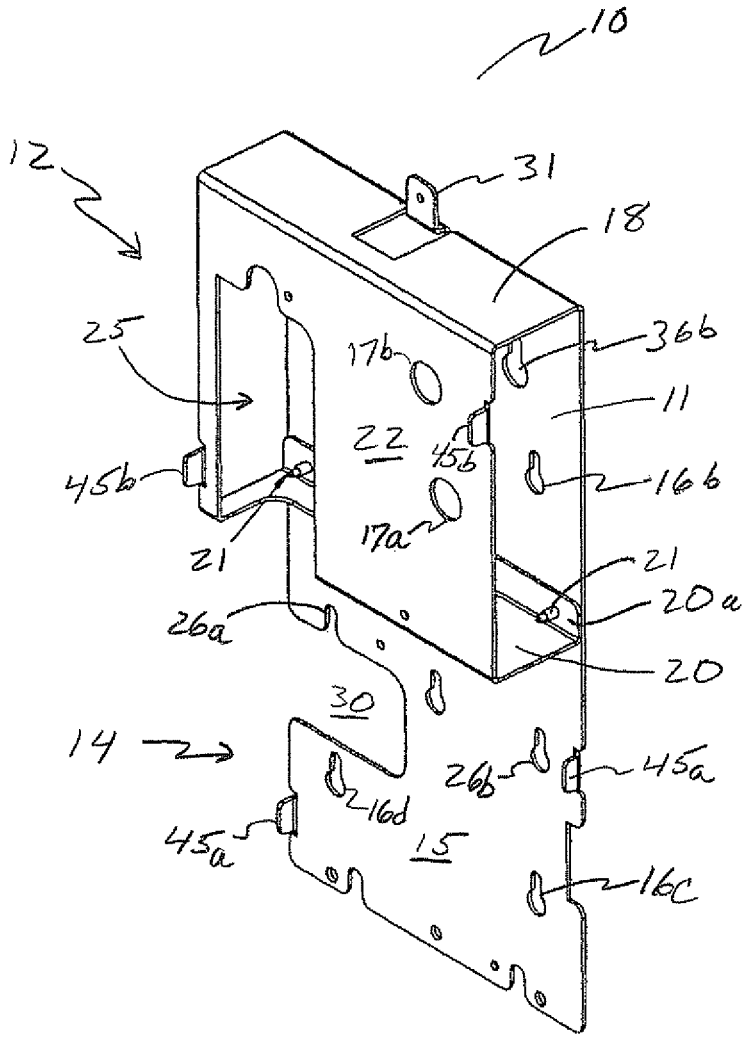
FIG. 1 is perspective view of an exemplary embodiment of a mounting bracket in accordance with the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 is a perspective view of an exemplary embodiment of a mounting bracket 10 which is defined by an upper mounting section 12 configured to receive an electrical component, for example an emergency strobe light and a lower mounting section 14 also configured to receive an emergency strobe light. Alternatively, upper and lower mounting sections 12 and 14 respectively may receive a single electrical component requiring an elongated mounting bracket. Back plate 15 has a generally rectangular shape with a thickness or approximately 0.05" and extends from upper mounting section 12 to lower mounting section 14. Upper mounting section 12 includes mounting face 22, upper wall 18 and lower wall 20 which, together with back plate 15 defines cavity 11. Upper wall 18 is disposed between back plate 15 and mounting face 22. A pull tab 31 extends above upper wall 18 and receives a fastener to retain a component cover plate. Lower wall 20 is disposed between back plate 15 and mounting face 22. Lower wall 20 may include a lip portion 20*a* which extends upward and connects to back plate 15 via fasteners 21. Mounting face 22 includes an opening or aperture 25 in which electrical wires are positioned and used to provide power to the strobes as will be described with reference to FIG. 3. Mounting bracket 10 has a particular length and width depending on the type of electrical component(s) to be mounted.

Figure 5:
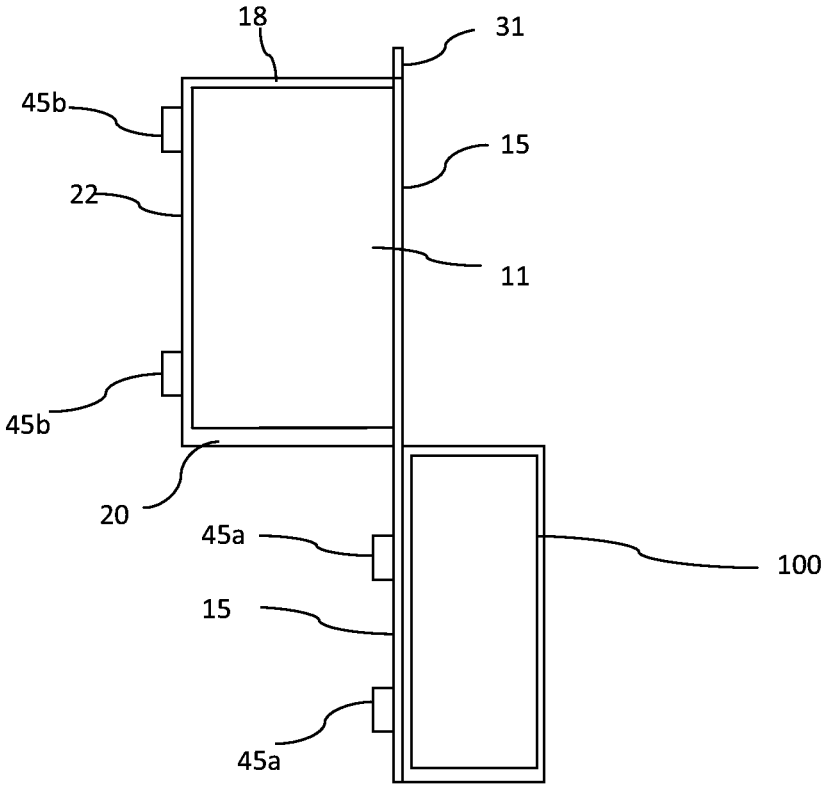
FIG. 5 is a side view of the mounting bracket of FIG. 1 engaged with a wall mounted electrical box.

Lower mounting section 14 includes a generally rectangular aperture 30 through which cables/wires extend for connection to the electrical components mounted on bracket 10. Aperture 30 may also have alternative configurations (e.g. square, circular, etc.) sufficient to allow wires to extend through back plate 15. Bracket 10 is typically attached to either a four (4) gang or 4" square standard electrical box 100 (see FIG. 5) recessed into a wall. Alternatively, mounting bracket 10 may be attached to an exterior device skirt which is attached to either a four (4) gang or 4" square box 100. When bracket 10 is mounted on a 4 gang electrical box 100, power wires are pulled through aperture 30 for connection to the electrical component mounted on bracket 10. The power wires enter via aperture 30 and are connected to the electrical component mounted on lower mounting section 14. Additional wires (jumpers) are connected from the electrical component mounted on lower mounting section 14 to the electrical component mounted on upper section 12 via mounting surface 22. By extending the back plate 15 from upper mounting section 12 to lower mounting section 14, an electrical box is formed as defined by mounting face 22, upper wall 18, lower wall 20 and back plate 15. This electrical box enclosure satisfies UL requirements associated with the location and protection of power supply wires for electrical components.

Figure 2:
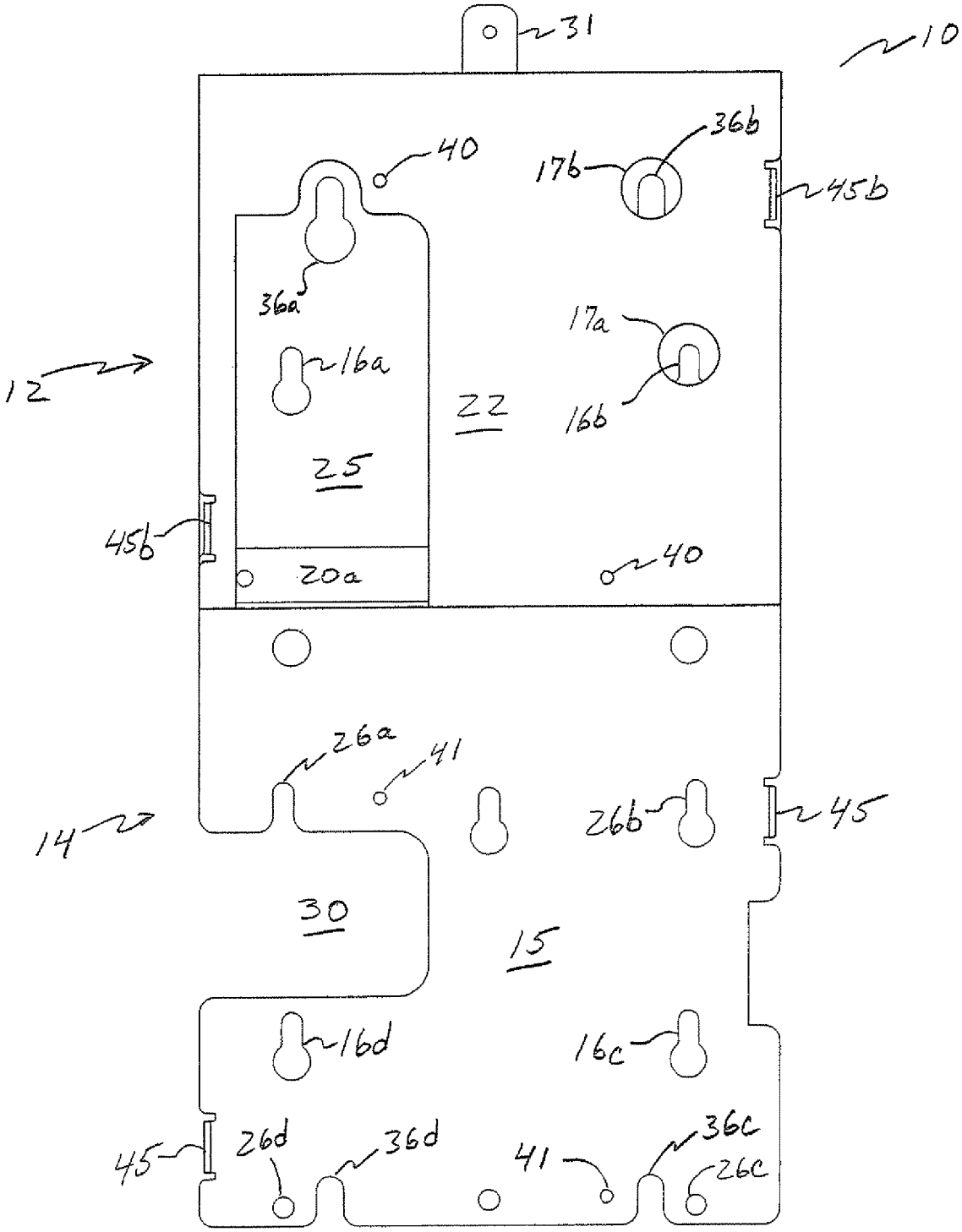
FIG. 2 is a front plan view of the mounting bracket in accordance with the present invention.

FIG. 2 is a front plan view of bracket 10 illustrating the fastening bores in back plate 15 for attachment to a 4" square electrical box, 4 gang electrical box 100 (see FIG. 5) or a surface mounted box. In particular, when bracket 10 is mounted to a 4 gang electrical box, fastening bores 16*a*, 16*b*, 16*c* and 16*d* are aligned with the threaded holes in the electrical box 100. Mounting face 22 includes hole 17*a* which is aligned with and provides access to fastening bore 16*b* such that a tool may be positioned through hole 17*a* to tighten or loosen the fastener positioned through bore 16*b*. When bracket 10 is mounted to a 4" square electrical box 100, fastening bores 26*a*, 26*b*, 26*c* and 26*d* are aligned with the threaded holes in the electrical box. In this configuration, only lower mounting section 14 is attached to the 4" electrical box 100, however, because back plate 15 extends from lower mounting section 14 to upper mounting section 12, mounting bracket 10 provides sufficient support for the electrical component attached to mounting face 22. When bracket 10 is mounted to a surface box on a wall, fastening bores 36*a*, 36*b*, 36*c*, and 36*d* are aligned with the threaded holes in the surface box. Mounting face 22 includes hole 17*b* which is aligned with and provides access to fastening bore 36*b* such that a tool may be positioned through hole 17*b* to tighten or loosen the fastener positioned through bore 36*b*. In this manner, mounting bracket 10 includes a plurality of fastening bores positioned through back plate 15 to allow for attachment to various electrical box configurations.

Figure 3:
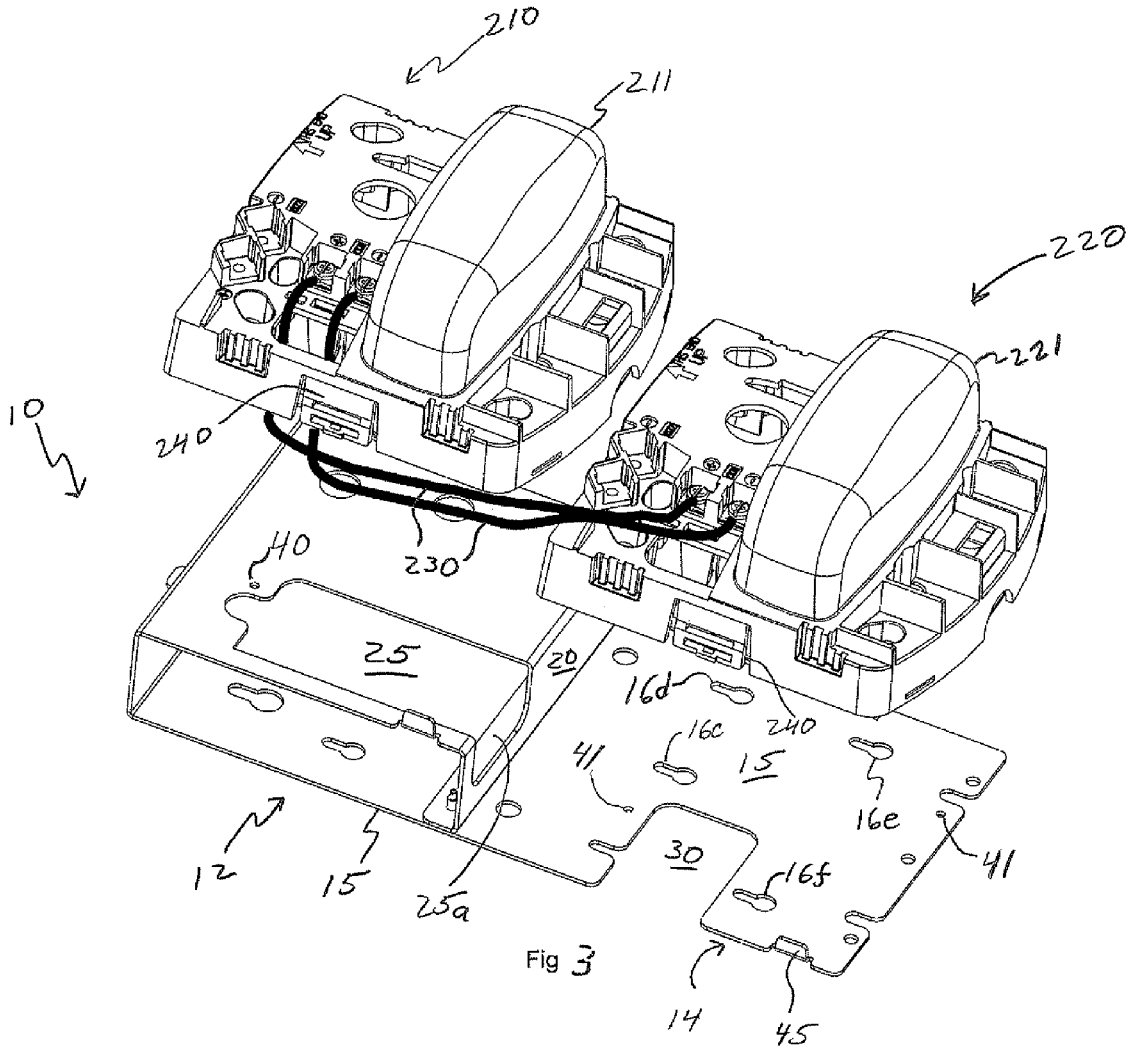
FIG. 3 is a perspective view of an exemplary embodiment of the mounting bracket shown in FIG. 1 together with strobe housings configured for mounting.

FIG. 3 is a perspective view of a dual V/O strobe configuration comprising a first emergency strobe 210 and a second emergency strobe 220 mounted on bracket 10. First emergency strobe 210 includes light 211 which may be, for example, an amber strobe which indicates an emergency other than fire. Second emergency strobe 220 includes light 221 which may be, for example, a clear white strobe to indicate a fire emergency. Preferably, each of the strobes 210 and 220 flash light at a specified rate and in a hemispherical pattern. The manufacture and installation of strobe alarms is governed by federal, state and municipal regulations which require conformance with particular UL guidelines. Typically, non-ire and fire strobes are wired on the same circuit and tied to a site fire panel or command station. Each of the strobes 210 and 220 share the same power cables or wires and must be installed according to such UL guidelines. In a dual strobe configuration as illustrated in FIG. 3, UL guidelines require that wiring between the first strobe 210 and second strobe 220 must be protected. In particular, field wiring associated with first strobe 210 and second strobe 220 must be made either within the electrical box 100 (see FIG. 5) upon which bracket 10 is mounted or within the enclosure of the strobe itself.

Figure 4:
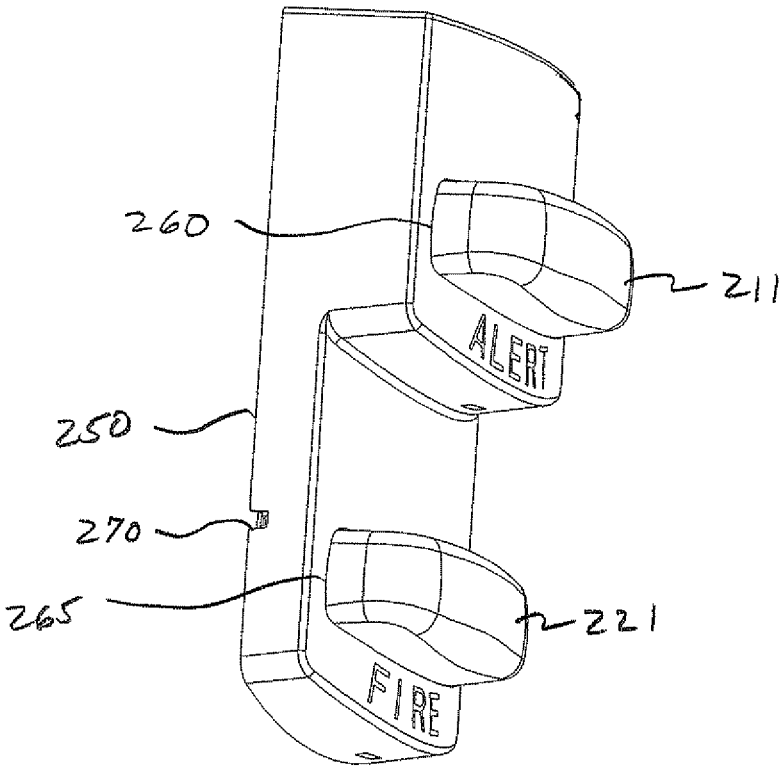
FIG. 4 is a perspective view of an exemplary emergency strobe light in accordance with the present invention.

First strobe 210 is mounted to mounting face 22 via threaded bores 40 and second strobe 220 is mounted to lower mounting section 14 via threaded bores 41. Snap clips 45*a*, located along the perimeter of upper mounting section 12, extend perpendicular to the plane of mounting face 22 and function to align and assist in retaining strobe 210 on bracket 10. Similarly, snap clips 45*b*, located along the perimeter of lower mounting section 14, extend perpendicular to the plane of back plate 15 and function to align and assist in retaining strobe 220 on bracket 10. Power wires pass through aperture 30 from an electrical box 100 (see FIG. 5) and connect to second strobe 220 to provide power to the dual strobe configuration. For example, power wires from the electrical box 100 are connected to second strobe 220 via aperture 30. Jumper wires 230 pass from second strobe 220 through lower portion 25*a* of opening 25 and connect to first strobe 210. Because back plate 15 extends from upper mounting section 12 to lower mounting section 14, the jumper wires 230 which extending between first strobe 210 and second strobe 220 are contained within the enclosure of bracket 10. As noted above, previous mounting brackets did not include the extension of back plate 15 between upper and lower mounting sections, but rather used the wall or ceiling of a building upon which the bracket was mounted as part of the enclosure to contain wires connected between the first and second strobes. This configuration did not satisfy UL guidelines for alarm notification devices. The enclosure formed by mounting face 22, upper wall 18 and lower wall 20 as well as back plate 15 which extends between upper mounting section 12 and lower mounting section 14 provides an enclosure for the electrical connections between first strobe 210 and second strobe 220. In this manner, mounting bracket 10 provides a support for a dual strobe emergency alert notification device as well as an enclosure which allows power wiring to pass to the strobe devices while providing an enclosure to protect wiring connections between the strobes. FIG. 4 illustrates a cover 250 positioned over first strobe 210 and second strobe 220. Cover 250 includes first opening 260 and second opening 265 through which light 211 of strobe 210 and light 221 of strobe 220 pass respectively when the cover is mounted over the strobes. Cover 250 is snap fit over the strobes via clips 240 (shown in FIG. 3) located on at least one side of each of strobes 210 and 220. Cover 250 includes at least one release aperture 270 to access clips 240 for cover removal.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A mounting bracket for mounting an alarm notification device comprising:

a generally planar back plate adapted to be disposed between said notification device and an electrical box for mounting thereto;

a first wall connected to and extending transversely from said back plate;

a second wall connected to and extending transversely from said back plate and dividing the back plate into a first mounting portion and a second mounting portion;

a mounting face extending between said first wall and said second wall generally parallel to said back plate; and an aperture disposed through said second wall and extending into said mounting face, the aperture extending through said mounting face at least a quarter of a distance from the second wall to the first wall;

wherein the first wall, the second wall, the back plate and the mounting face define an enclosure for housing electrical wires.

2. The mounting bracket of claim 1 further comprising an opening disposed through said first mounting portion of said back plate configured to receive electrical wires extending from said electrical box to said notification device.

3. The mounting bracket of claim 2 wherein said aperture is aligned with at least a portion of said opening in said first mounting portion of said back plate.

4. The mounting bracket of claim 1 wherein said aperture extends through said mounting face at least half of the distance from the second wall to the first wall.

5. The mounting bracket of claim 1 wherein said aperture has a generally rectangular shape.

6. The mounting bracket of claim 1 further comprising a plurality of fastening bores disposed through said back plate for receiving fasteners to connect said bracket to said electrical box.

7. The mounting bracket of claim 1 further comprising a plurality of threaded bores disposed through said second mounting portion of said back plate, said threaded bores adapted to receive fasteners to mount said notification device to said second mounting portion of said back plate.

8. The mounting bracket of claim 1 further comprising a plurality of threaded bores disposed through said mounting face, said threaded bores adapted to receive fasteners to mount said notification device to said mounting face.

9. The mounting bracket of claim 1 further comprising a tab extending above said first wall, said tab having a threaded bore configured to receive a fastener to retain a cover plate positioned over at least a portion of said notification device.

10. The mounting bracket of claim 1 further comprising at least one snap tab protruding perpendicular to said back plate and configured to align and retain a first portion of said notification device on said back plate.

11. The mounting bracket of claim 1 wherein said second mounting portion of said back plate is adapted to be mounted to said electrical box.

12. The mounting bracket of claim 1 wherein said first mounting portion and said second mounting portion of said back plate are adapted to be mounted to said electrical box.

13. A visual alarm device and mounting bracket apparatus comprising:

a generally planar back plate;

a first wall connected to and extending transversely from said back plate;

a second wall connected to and extending transversely from said back plate and dividing said back plate into a first mounting portion and a second mounting portion;

a mounting face extending between said first wall and said second wall generally parallel to said back plate;

the visual alarm device comprising a first alarm device mounted on said mounting face and a second alarm device mounted on said second mounting portion of said back plate;

and an aperture disposed through said second wall and extending into said mounting face, said aperture extending through said mounting face at least a quarter of a distance from the second wall to the first wall;

wherein the first wall, the second wall, the back plate and the mounting face define an enclosure for housing electrical wires connecting the first and second alarm devices.

14. The apparatus of claim 13 further comprising an opening disposed through said first mounting portion of said back plate configured to receive electrical wires from an electrical box to said first alarm device.

15. The apparatus of claim 14 wherein said aperture is aligned with at least a portion of said opening in said first mounting portion of said back plate.

16. The apparatus of claim 13 further comprising a plurality of fastening bores disposed through said back plate for receiving fasteners to connect said bracket to an electrical box.

17. The apparatus of claim 13 further comprising a plurality of threaded bores disposed through said mounting face, said threaded bores receiving fasteners to mount said first alarm device to said mounting face.

18. The apparatus of claim 13 further comprising a plurality of threaded bores disposed through said second mounting portion of said back plate, said threaded bores receiving fasteners to mount said second alarm device to said second mounting portion.

19. The apparatus of claim 13 further comprising a cover disposed over at least a portion of said first and second alarm devices.

20. The apparatus of claim 13, wherein the enclosure further comprises an electrical box.

* * * * *